US007182341B2

(12) United States Patent
Conner

(10) Patent No.: US 7,182,341 B2
(45) Date of Patent: Feb. 27, 2007

(54) TORA

(76) Inventor: Kevin Joel Conner, 11636 Community Center Dr. #30, Northglenn, CO (US) 80233

( * ) Notice: Subject to any disclaimer, the term of this patent is extended or adjusted under 35 U.S.C. 154(b) by 161 days.

(21) Appl. No.: 10/884,422

(22) Filed: Jul. 3, 2004

(65) Prior Publication Data

US 2006/0001213 A1 Jan. 5, 2006

(51) Int. Cl.
*A63F 3/00* (2006.01)

(52) U.S. Cl. ..... 273/260; 273/261

(58) Field of Classification Search ..... 273/260, 273/261

See application file for complete search history.

(56) References Cited

U.S. PATENT DOCUMENTS 4,373,731 A * 2/1983 Whiteman et al. ..... 273/262

* cited by examiner

*Primary Examiner*—Vishu K. Mendiratta
(74) *Attorney, Agent, or Firm*—Leyendecker & Lemire, LLC; Kurt Leyendecker

(57) ABSTRACT

"Tora" is a classical strategy board game, constructed as a two-tiered, three-pronged, battlefield simulation. Using 7, 27 or 28 classical pieces at their disposal, players have the option to contend on a limited (9×9) or expanded (17×17) field of contest to determine the future course of history!

12 Claims, 21 Drawing Sheets

Opposition Challenger

Key: Archers = "A", Soldiers = "S", Calvary = "H", Cannons = "C", Generals = "G", King = "K", & Queen = "Q".

Fig. 1

Opposition Challenger

| | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|
| 2 | | | | | | | | | | | | | | | | | |
| 3 | | | | | | | | | | | | | | | | | |
| 4 | | | | | | | | | | | | | | | | | |
| 5 | | | | | | | | | | | | | | | | | |
| 6 | | | | | | | | | | | | | | | | | |
| 7 | | | | | | | | | | | | | | | | | |
| 8 | | | | | | | | | | | | | | | | | |
| 9 | | | | | | | | | | | | | | | | | |
| 10 | | | | | | | | | | | | | | | | | |
| 11 | | | | | | | | | | | | | | | | | |
| 12 | | | | | | | | | | | | | | | | | |
| 13 | | | | | | | | | | | | | | | | | |
| 14 | | | | | | | | | | | | | | | | | |
| 15 | | | | | | | | | | | | | | | | | |
| 16 | | | | | | | | | | | | | | | | | |
| 17 | | | | | | | | | | | | | | | | | |

©

Opposition Challenger

©

Opposition Challenger

©

Opposition Challenger

©

Opposition Challenger

©

Opposition Challenger

Fig. 7

Opposition Challenger

| | 1 | 2 | 3 | 4 | 5 | 6 | 7 | 8 | 9 | 10 | 11 | 12 | 13 | 14 | 15 | 16 | 17 |
|---|---|---|---|---|---|---|---|---|---|---|---|---|---|---|---|---|---|
| 17 | | | | | | | | | | | | | | | | | |
| 16 | | | | | | | | | | | | | A | | | | |
| 15 | | | | | S | A | | | | | | S | | | | | |
| 14 | | | | G | S | A | | | | | A | S | G | | | | |
| 13 | | | | | S | A | | | | | | S | | | | | |
| 12 | | | | | | | | | | | | | A | | | | |
| 11 | | H | S | | | | | | | | | | | | | S | H |
| 10 | | H | A | S | | | | | | | | | | | S | A | |
| 9 | Q | | A | S | | | | | | | | | | S | A | | K |
| 8 | | H | A | S | | | | | | | | | | | S | A | |
| 7 | | H | S | | | | | | | | | | | | | S | H |
| 6 | | | | | | | | | | | | | | A | | | H |
| 5 | | | | | | S | A | | | | | | S | | | | |
| 4 | | | | | G | S | A | | | | | A | S | G | | | |
| 3 | | | | | | S | A | | | | | | S | | | | |
| 2 | | | | | | | | | | | | | | A | | | |
| 1 | | | | | | | | | | | | | | | | | |

©Fig. 7 Key: Archers = "A", Soldiers = "S", Calvary = "H", Cannons = "C", Generals = "G", King = "K", & Queen = "Q".

Fig. 8

Opposition Challenger

| 1 | 2 | | | | | | | 8 | 9 |
|---|---|---|---|---|---|---|---|---|---|
| 2 | | | S | C | | S | | | |
| 3 | | | A | A | | A | | | |
| 4 | | | | | | | | | |
| 5 | | | | | | | | | |
| 6 | | | | | | | | | |
| 7 | | | | A | | | | | |
| 8 | | | S | C | | S | | | |
| 9 | | A | | G | | | A | | |

©Fig. SB1 Key: General = "G", Archer = "A", Cannon/Catapult = "C", Soldier = "S"

Opposition Challenger

©

Opposition Challenger

©

Opposition Challenger

©

©

©

©

©

©

©

©

©

©

©

©

TORA

STATEMENT REGARDING FEDERALLY SPONSORED RESEARCH OR DEVELOPMENT

Not Applicable

REFERENCE TO SEQUENCE LISTING

Not Applicable

BACKGROUND OF THE INVENTION

This invention's ("Tora"s) background is in the field of classic strategy board games (such as Chess, Checkers, Go, Chinese Chess, or any other boardgame played on a grid surface.) This invention details the process to play this new and original board game, as well as the designation and creation of 17 by 17 or 9 by 9 grid playing areas specific to this game's operation, and the operational mathematical tournament structure required for this board game to operate on a tournament level.

BRIEF SUMMARY OF THE INVENTION

This invention is the detailed process of how to play this game: "TORA" on 17 by 17 or 9 by 9 grid playing areas specific to this game's operation.

It is an original strategy game in the same genre as Go, Chess, Checkers, or any other board game which utilizes a grid form as its method for operation/game play. While it is in the same field/genre as these board games, the operation and method of play is distinct and original from any other form of play. The pieces operation method, tournament calculation method, and board marking methods, are also distinct to the specific gameplay method required to operate this game: "Tora".

BRIEF DESCRIPTION OF SEVERAL VIEWS OF THE DRAWING

FIGS. 1 through 7 (FIG. 1, FIG. 2, FIG. 3, FIG. 4, FIG. 5, FIG. 6, FIG. 7) are all representations of the Long Board (Checkered Board and Graph Board types) according to one embodiment of the present invention.

FIGS. 8–11 depict the various representations of the Short Board (Checkered Board and Graph Board types) according to one embodiment of the present invention.

DETAILED DESCRIPTION OF THE INVENTION

The following is a detailed description of the invention: "TORA" and the means necessary to complete the process required to play/operate the game "Tora" in these following chapter sections, chapter sub-sections and subsequent sub-sections:

CHAPTER SECTIONS:
- GAME CONTENTS
- THE LONG BOARD
- PIECE PLACEMENT LISTS
- TERRAIN EFFECTS
- GAMEPLAY, PIECES & THEIR DESCRIPTIONS
- CHAPTER SUB-SECTION: COMMAND PIECES
- CHAPTER SUB-SECTION: STANDARD PIECES
- OPTIONAL RULES:
- CHAPTER SUB-SECTION: HIGH GROUND TERRAIN
- CHAPTER SUB-SECTION: ASSASSIN RULES
- CHAPTER SUB-SECTION: SHORT BOARD
  - SUB-SECTION: PIECE PLACEMENT
  - SUB-SECTION: SHORT BOARD CREATION/DESIGN
- CHAPTER SUB-SECTION: SCORE KEEPING
  - SUB-SECTION: COMPOUND POINT RULES
  - SUB-SECTION: POINT TALLIES FOR GAME PIECES
- CHAPTER SUB-SECTION: TOURNAMENT RANKING
  - SUB-SECTION: CALCULATING RANKING POINT VALUE
  - SUB-SECTION: GAME POINTS
  - SUB-SECTION: CHEATING AND SUBSTITUTE PLAYERS
  - SUB-SECTION: SHORT BOARD TOURNAMENT RULES

Game Contents

| | |
|---|---|
| Archers | 18 |
| Soldiers | 18 |
| Calvary | 8 |
| Cannons/Catapults | 4 |
| Generals | 4 |
| King | 2 |
| Queen | 2 |
| Assassin | 2 |
| Score Markers | 4 |

The Long Board

There are two different methods of playing the game described herein as "Tora".

The primary method is on a Long Board. The pieces of this version are either played on the checkers of a 17.times.17 checkered board (called the checkered board), or they are played on the cross sections of a 16.times.16 checkered board (called the graphed board).

The difference between these two boards is purely aesthetic. Some people prefer to play on the cross sections while others prefer to play on checkers.

In either case, each row of either checkers or graphed lines are numbered 1–17; right to left and up to down from the challenger's perspective.

Figure 2:
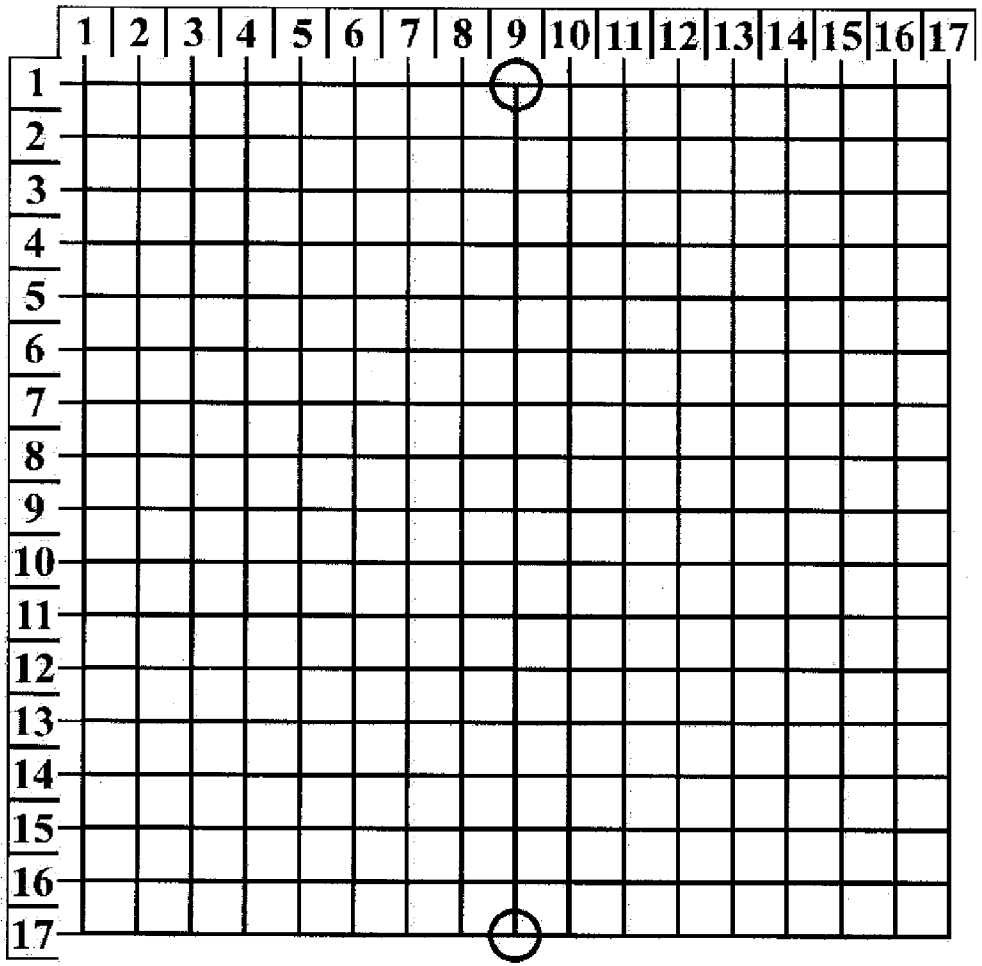

The following is a graphical representation of the two boards and their numbering systems (see enclosed images FIG. 1 & FIG. 2). The boards are presented on their side, with the Opposition on the right and the Challenger on the left.

Please notice, the vertical rows appear Horizontal, this is because the boards are on their sides to better demonstrate the positions of both the Challenger and Opposition. On the Checkered Board example (FIG. 1), the checkered rows are numbered and marked. On the Graph Board example (FIG. 2), the lines are numbered and marked.

On the Graph Board, you will notice that the King/Queen starting positions are marked, to better demonstrate their location. On the Checkered board, each player's King/Queen is placed on the checkered squares rather than the intersecting lines so no example is given The numbers/start positions are placed for the viewers benefit, and do not actually need to be marked on the game board.

There are three major graphical designs for this game. One, seen on the included Figures (FIG. 1 "Checkered Board" & FIG. 2 "Graph Board"), is the plain board. They are simple 17.times.17 checkered or 16.times.16 checkered (depending on whether you are using Checkered Board or Graph Board respectively).

The other two boards are the:

Water Board

&

Forest Board

Figure 3:
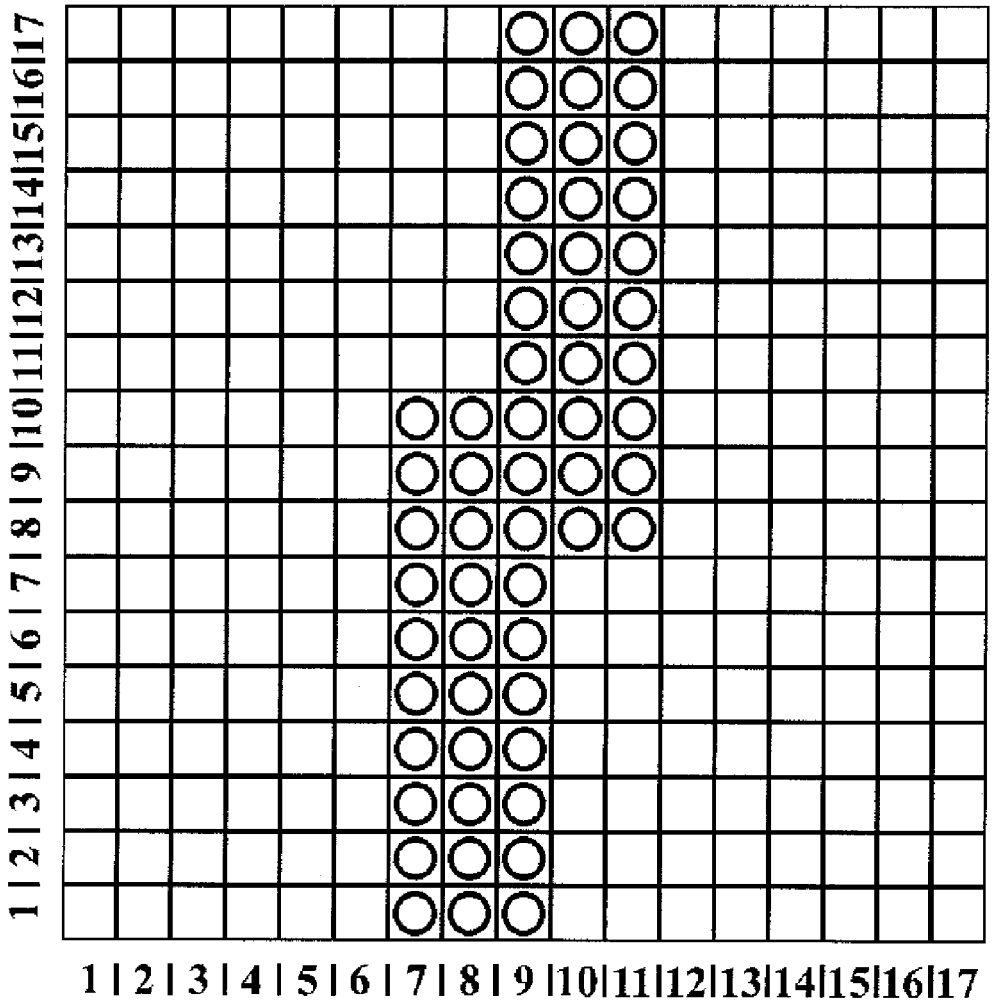
Figure 4:
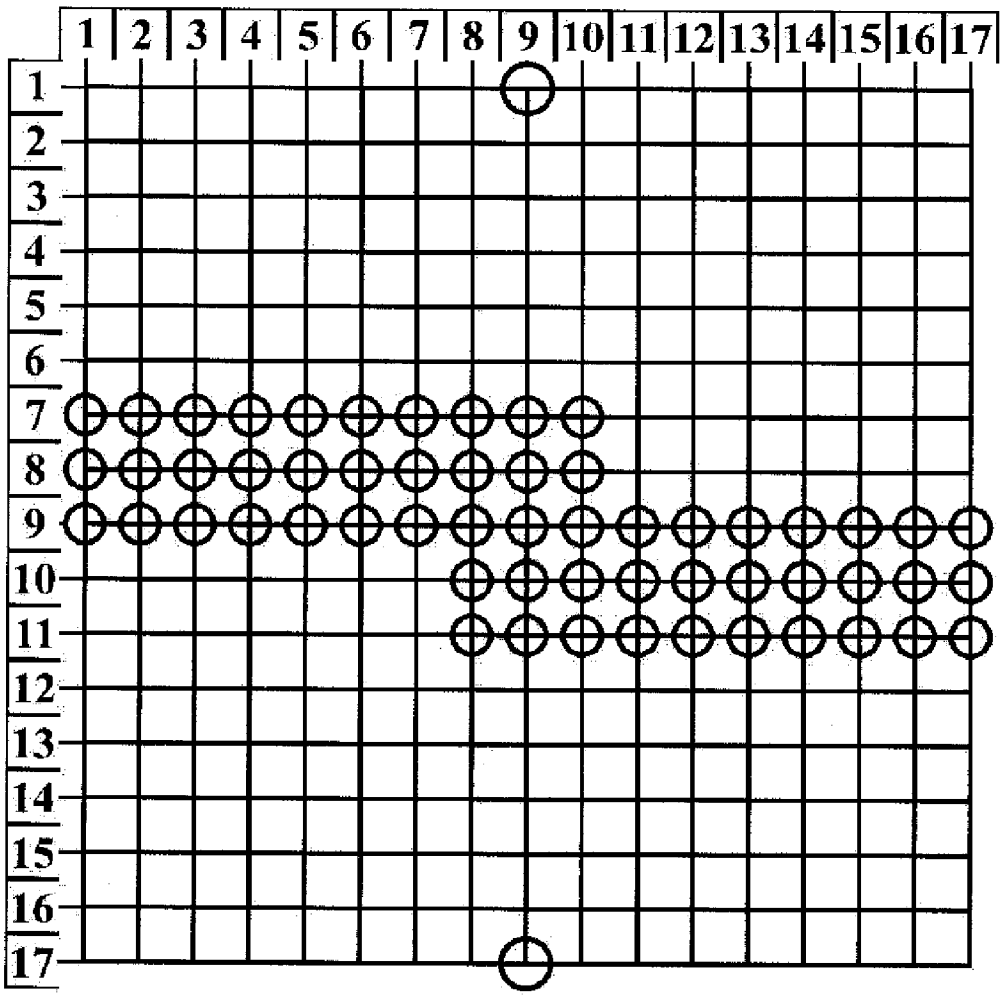

The "Water Board" consists of tiles marking a river in the center of the board with a kink in the center. This "water" covers the full width of the board, and is 3 spaces high. The locations of the "water" spaces are given with their Vertical number first, followed by Horizontal (see FIG. 3 and FIG. 4):

v.1-10.times.h.7-8 h.9 is completely filled through v.8-17.times.h10-11

The effects of these water tiles are described after this section under "Terrain Effects".

On the Checkered Board example (FIG. 3), the checkered rows are numbered and marked. On the Graph Board example (FIG. 4), the lines are numbered and marked.

In both examples, Water Positions are indicated by a hollow circle. When colorized the hollow circles appear as blue, in the presented Black and White graphics, however, they appear dark grey or black.

The other board type is called the "Forest Board". The "Forest Board" consists of tiles marking the presence of both "water" and "trees".

This board has a river running through the mean of the board, with a small island in the center –3 spaces wide and 1 space high.

On each player's perspective left side, there is a representation of a small cropping of trees. This outcropping looks like a plus sign, or pixilated "dot". As if two sticks, 3 spaces wide by 5 spaces in length were crossed over each other.

Like "water" spaces, the effects of these "forest" spaces are covered under the section titled "Terrain Effects".

The locations of "water spaces" are as follows:

v.1-6.times.h.9 v.7.times.h.8-10 v.8-10.times.h.8 v.8-10.times.h.10 v.11.times.h.8-10 v.12-17.times.h.9

The locations of "tree" spaces are as follows:

v.2.times.h.12-14 v.3-5.times.h.1-15 v.6.times.h.12-14 v.12.times.h.4-6 v. 13-15.times.h.3-7 v.16.times.h.4-6

Figure 5:
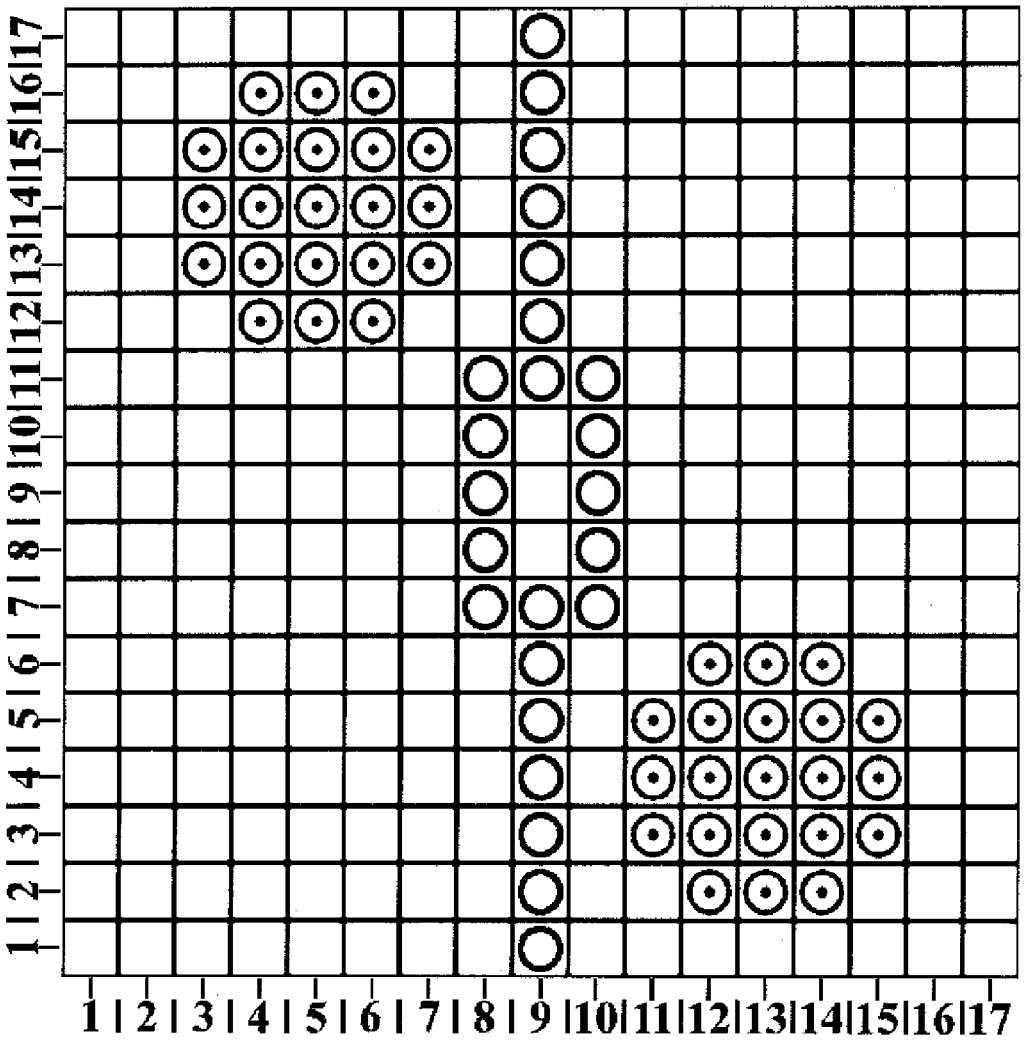
Figure 6:
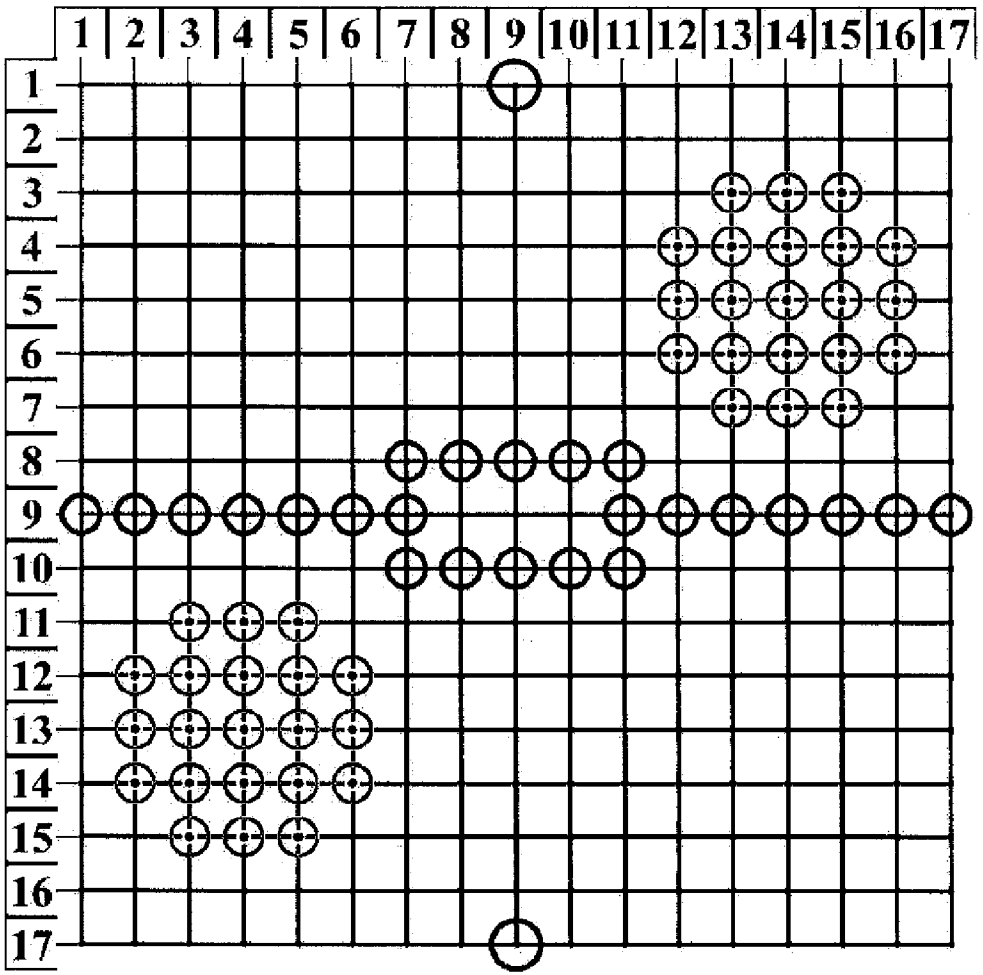

The graphic representations of these boards are presented in the Figures: FIG. 5 and FIG. 6. On the Checkered Board (FIG. 5), the rows and marker placement are on the checkers. On the Graph Board (FIG. 6), the rows and marker placement are on the grid lines.

Forest Marks are represented by a Circle with a Dot in the center of the circle (when in color, these circles and dots are green, but in black and white, these circles and dots are dark grey or black). Water Marks are represented by a Hollow Circle (when in color, these circles are blue, when in black and white these circles are dark grey or black).

Piece Placement Lists

The King or Queen of each player is always located on the middle most vertical row (row 9), on the horizontal row closest to the player (row 17 for the challenger and row 1 for the opposition). Like the King and Queen pieces, the Generals and Cannons/Catapults are always located in the same starting positions.

For the Challenger:

Generals are located on either side of the main force.

v.4, h.14

& v.14, h.13

Cannons are located one step towards the Opposition in the same Vertical Row as the generals:

v.4, h.13

& v.14, h.12

For the Opposition:

Generals are placed in the same relative positions:

v.4, h.5

& v.14, h.4

Cannons/Catapults are likewise placed in relative positions on the board:

v.4, h.6

& v.14, h5

The rest of the pieces are placed around these anchored positions, depending on the formation type each player has chosen at the beginning of the game (Aggressive or Defensive).

Commonly, the Queen is used for players playing Defensive positions, and the King is used for players playing Aggressive positions, however, this is purely aesthetic, and a player is not limited to playing a King if they are playing an Aggressive position.

Also, Positions of Soldiers and Archers may be exchanged. Players wishing to switch the positions of their Soldiers and their Archers must switch all positions respectively (you cannot decide to exchange one or even 5 Archers with 5 Soldiers. If you exchange 1 Archer's position with 1 Soldier, you must do it with all 9 Archers and all 9 Soldiers).

The terms "Aggressive" and "Defensive" simply refer to the starting the player desires for his pieces. There is no specific form in which the player must act while playing, however, the starting formations for defensive forces are tighter/closer together. This allows for greater protection of generals and royalty. Aggressive forces are more widely spread, allowing for quicker land coverage, but this also creates holes in the defenses around the generals and royalty.

The two formations for both Defensive and Aggressive are presented in Figure FIG. 7. The Figure example uses a Checkered Board for clarity and does not require players use the exact same setup of one player playing "Aggressive" and another "Defensive". Both players may be "Aggressive" or both may be "Defensive" or one may be one and another may be another (etc.). Assume the same placement on a Graph Board, only with the pieces placed on intersecting lines instead of the checkers.

If Assassin rules are used in a game, the Assassin piece is never placed on the board at the start of the game. Rather, the piece's position is recorded on a piece of paper (or other object). Rules for Assassins are provided under Optional Rules.

Each side has 9 Archers, 9 Soldiers, 4 Cavalry, 2 Cannons/Catapults, 2 Generals, 1 King or Queen, and 1 Assassin piece if playing with the Assassin Rules. Each player may also keep score, with either 4 generic score markers or with pencil and paper.

9*Archrs—Defensive Opposition:

(v.3, h.7), (v.4, h.7), (v.5, h.7)|(v.13, h.6), (v.14, h.6), (v.15, h.6)|(v.8, h.3), (v.9, h.3), (v.10, h.3)

9*Archers—Defensive Challenger:

(v.3, h.12), (v.4, h.12), (v.5, h.12)|(v.13, h.11), (v.14, h.11), (v.15, h.11)|(v.8, h.15), (v.9, h.15), (v.10, h.15)

9*Archers—Aggressive Opposition:

(v.2, h.5), (v.4, h.7), (v.6 h.5)|(v.12, h.4), (v.14, h.6), (v.16, h.4)|(v.8, h.2), (v.9, h.3), (v.10, h.2)

9*Archers—Aggressive Challenger:

(v.2, h.14), (v.4, h.12), (v.6 h.14) (v.12, h.13), (v.14, h.1), (v.16, h.13)|(v.8, h.16), (v.9, h.15), (v.10, h.16)

9*Soldiers—Defensive Opposition:

(v.3, h.6), (v.5, h.6)|(v.13, h.5), (v.15, h.5)|(v.7, h.3), (v.8, h.4), (v.9, h.4), (v.10, h.4), (v.11, h.3)

9*Soldiers—Defensive Challenger:

(v.3, h.13), (v.5, h.13)|(v.13, h.12), (v.15, h.12)|(v.7, h.15), (v.8, h.14), (v.9, h.14), (v.10, h.14), (v.11, h.15)

9*Soldiers—Aggressive Opposition:

(v.3, h.6), (v.5, h.6)|(v.13, h.5), (v.15, h.5) (v.7, h.2), (v.8, h.3), (v.9, h.4), (v.10, h.3), (v.11, h.2)

9*Soldiers—Aggressive Challenger:

(v.3, h.13), (v.5, h.13)|(v.13, h.12), (v.15, h.12)|(v.7, h.16), (v.8, h.15), (v.9, h.14), (v.10, h.15), (v.11, h.16)

Soldier and Archer starting positions may be exchanged

4 Cavalry—Defensive Opposition:

(v.7, h.2), (v.8, h.2), (v.10, h.2), (v.11, h.2)

4 Cavalry—Defensive Challenger:

(v.7, h.16), (v.8, h.16), (v.10, h.16), (v.11, h.16)

4 Cavalry—Aggressive Opposition:

(v.6, h.1), (v.7, h.1), (v.11, h.1), (v.12, h.1)

4 Cavalry—Aggressive Challenger:

(v.6, h.17), (v.7, h.17), (v.11, h.17), (v.12, h.17)

Remember, FIG. 7 is a representation of both forms of game setup, and can be changed or altered depending on which player uses what initial strategy. i.e.: the challenger may decide to play Defensive, thus setting up a defensive formation like the Opposition is pictured in FIG. 7, with a King or Queen as his/her royalty.

FIG. 7 is black and white, with piece markers placed on the board to represent the appropriate piece according to piece setup described above (see the FIG. 7 Key under FIG. 7)

Terrain Effects

In the board descriptions you heard about "forest" and "water" locations marked on some of the board. These locations have effects which are both beneficial and detrimental.

A game does not need to be played with these terrain markers, however, it does add an extra variable to gameplay if used.

Forest Markers

These markers reduce an Archer's range when firing into a space marked as a "tree/forest". An Archer firing into a space marked as a "forest" (or "tree"), is reduced to 1 space in its attack distance. Other pieces, such as Kings/Queens, and Cannons/Catapults have no such limitation.

If an archer is at the edge of a "tree/forest" location (let's say: v. 12, h.6), and is firing away from a "forest/tree" location (v.12, h.8), the Archer can fire two spaces. But, if the same archer (v.12, h.6) is firing into a space marked as a "tree" (v.13, h.6), then the archer can only fire to one adjacent location rather than 2 (i.e., the archer cannot fire to location v.14, h.6, even if the Archer would normally have the ability to shoot 2 spaces).

Water Locations

Locations marked as "water" reduce the collective movement of all pieces passing through. Any piece passing through a space marked as "water", has its movement reduced by 1 (to a minimum of 1).

Also, Cannons/Catapults must have 3 adjacent pieces to move it forward, rather than just 2 adjacent pieces.

Since each piece has a minimum movement of 1, an Archer can move 1 space through water and shoot 1 space in either direction. They are not forced to use their entire ability as movement.

Gameplay, Pieces & their Descriptions

The objective of the main game is to eliminate the opponent's King/Queen and Generals from play. These pieces are considered Command Pieces. If the opposing player cannot make a move without putting their command pieces in jeopardy, then the game is considered won.

The Challenger always begins the game.

If playing with the Option Score Keeping Rules, a player may be handicapped so they can win by a smaller point value than the opponent.

In case of a tie: when both players unwittingly eliminated their final command pieces in the same turn/round, or where neither player can move without putting their final command piece in jeopardy, then the game may either be resolved by point tally (if the Optional Rules are used), or considered a tie with neither being a clear victor.

Each player's turn is part of a round, as in real life, soldiers don't wait for the opposing army to shoot in turn before shooting themselves.

i.e.:

Player 1 completes his turn, Player 2 then takes his turn. When Player 2 completes her turn, the first round is over. A command piece is never removed from the board until the round is over. However, all other non-command pieces (the Cavalry, Cannons/Catapults, Soldiers, Archers and Assassin), are removed from the board during the player's turn in which they are attacked. i.e.: Player 1 attacked Player 2's Archer and Player 2's King. The Archer is immediately removed, however, Player 2 keeps his King on the board until the round is over (when Player 2's turn ends).

Each player may declare as many actions as his/her number of Command Pieces on the board.

Each Action is used to move/operate a single piece as is in it's description.

i.e.:

Player 1 has 2 Generals and 1 King, allowing Player 1 three actions. Player 1 has decided to expend only 2 of the 3 actions: Moving an Archer 1 space and attacking an enemy soldier in the adjacent space with 1 action (as allowed under the rules), and by moving a Cavalry Piece 2 spaces to attack and kill 1 of Player 2's soldiers.

Player 1 still has 1 action left, but decides not to use it.

Movement must always precede the Attack. For instance: an archer must move first before it attacks, so must a Cavalry piece, a General, Soldier (its movement is part of it's attack), etc . . .

As described under Cannon/Catapult and Soldier piece descriptions: Un-readied pieces (such as Soldiers or Cannons/Catapults), must first be readied before being moved.

Readying a piece costs 1 Action.

The Challenger always begins the game.

A player receives no bonus for reaching the opposing player's side of the board.

Pieces can move in any direction, as long as the terrain and the piece's rules allows it.

When a piece has been attacked (such as with a cannon shooting, soldier landing on the same space, etc.), it is removed from the board and considered dead (except for a Command Piece—King/Queen/General, those remain until the end of the round before they are removed). A piece that may attack one more or more spaces in an adjacent direction, can still attack when it lands on an enemy piece (but if a piece attacks in this fashion, it has still used its attack).

The main pieces in is game are: King, Queen, General, Cavalry, Cannons/Catapults, Archers and Soldiers.

The Assassins are listed under Optional Rules.

Graphics for each piece's suggested design are provided on the appropriately labeled attached papers. These pieces do not have to use this design to mark it, but the Figures are given for those who wish to use that piece's specific design. These images are protected by copyright and not by a design patent. They are simply provided as an example.

The design, shape and size of the piece should match the type of board the piece is played upon, as it otherwise has no bearing on the gameplay.

Command Pieces

The King/Queen:

As described earlier, each player chooses whether their royalty will be the King or Queen. This has no bearing on the game, as each piece is treated equally on the game board.

There can only be 1 King or Queen for each player on the board at any one time. If a King or Queen is eliminated from play, then the player must choose 1 General and replace that piece with their eliminated King or Queen.

If the player has no Generals left on the board when he/she loses a King/Queen, then he/she loses the game.

A King/Queen can move up to 3 spaces in any direction, and they can attack up to 2 spaces in any direction.

The King/Queen provides 1 action.

The Generals:

Generals may move up to 2 spaces in any direction, and attack up to 1 adjacent space in any direction. When a King/Queen is removed, a General chosen by the player who lost the King/Queen is replaced with a King/Queen marker. This general is now a King/Queen.

Each General provides 1 action.

Standard Pieces

The Cavalry (Horsemen):

Cavalry can move up to 3 spaces in any direction. Cavalry may jump across any piece, except a Soldier in Defense Position.

If a Cavalry piece lands on a Soldier in Defense position, then both pieces are removed from play.

The Cannons/Catapults:

A Cannon/Catapult must have 2 friendly pieces in adjacent spaces in order to be fired or to be moved. A Cannon/Catapult can be moved outside of range of 2 friendly pieces, but for it to be moved or used again, the pieces must move within 1 space of the cannon.

Two friendly adjacent pieces can move a Cannon/Catapult 1 space in any direction.

Two friendly adjacent pieces may attack with the cannon. A Cannon/Catapult that attacks is flipped upside down (or otherwise marked), a cannon so marked is considered used and unready. This piece cannot be moved or fired when unready.

It takes 1 action to ready a Cannon/Catapult, and it may be readied/un-readied in the same turn (as long as you have the number of actions necessary). This piece can only be ready if there are two friendly adjacent pieces.

When a Cannon/Catapult fires it shoots in a straight line until it reaches the end of a board or hits a piece: vertical, diagonal or horizontal in any valid direction (such as a compass with this piece at its center: N-NE-E-SE-S-SW-W-NW-N).

A Cannon/Catapult can only kill 1 piece at a time, and it cannot shoot over friendly pieces. Any piece in the way of its attack is removed. The player using this piece chooses what direction it fires.

Cannons/Catapults can only be removed from the board/destroyed, they cannot be captured and used by enemy forces.

Friendly pieces used to fire/move/ready a catapult cannot be used for any other actions.

The Archers:

Archers are special. They have the ability to move, or fire, or move and fire. An Archer can move either 2 spaces and not attack (if they choose this, then they cannot move 2 spaces and land on an enemy), they can move 1 space and attack up to 1 adjacent space. Or they can stand still and attack up to 2 spaces away.

When an Archer fires, it can usually shoot over pieces. However, an Archer cannot jump over pieces.

As always their movement and attack is optional (for instance, they can move 1 space and do nothing, no piece is forced to carry out an attack).

The Soldiers:

Soldiers can only move 1 space in any direction, automatically attacking the space on which they land. However, Soldiers can also be flipped upside down (or otherwise marked), to indicate that they are in defense mode. An archer cannot shoot over a soldier who is defending. The defending soldier must be shot instead. Also, a Cavalry piece cannot jump over a defending soldier, both pieces are removed from the board (killed by each other), if a Cavalry piece attempts to jump over a defending Soldier. A Soldier expends one action when changing to defense or attack mode. A Solder in defense mode cannot move. A soldier can switch from defense mode to attack mode and then attack or vice versa (attack then switch to defense mode), if the controlling player has enough actions necessary to move and switch positions.

A Final Note:

Command forces may never willfully enter a square that would put them in jeopardy (i.e.: any square within striking range of a piece's next move), unless they eliminate a command piece in the same move.

Optional Rules

There are three optional rules:
High Ground Terrain
Assassin Rules
Short Board
Score Keeping
Tournament Ranking

High Ground Terrain

This optional rule may be used at tournaments or in casual play on any gameboard. The only restrictions to High Ground Terrain is that the spaces must be clearly marked or displayed, and when in tournament play, both players must either be playing on an A-Symmetrically board, or they must change turns (being given an equal opportunity on each side).

When identifying entire blocks of spaces which are considered High Ground, a single large arrow may be used (if necessary—if the entire board or half of the entire board is considered high ground in one direction, it's not necessary). If single spaces, or small groups are high ground, then individual arrows need to mark each space.

An arrow's direction shows which is high ground and which is low ground.

Arrows always point downhill.

Traveling straight or horizontally against the arrow's direction is moving up a hill. Traveling straight or horizontally toward the arrow's direction is moving down hill.

Traveling horizontal with the arrows direction yield's no change in movement.

If a piece travels over a marked space, and is moving uphill, the piece's movement is reduced by 1 to a minimum of 1 (as in the case of "water").

If a piece is moving over a marked space, and is traveling downhill, the piece is allowed to move 1 more space in the appropriate direction (either diagonally to or straight with the arrow's direction).

Several methods for High Ground rules include:

- when moving toward the center of the board you are coming down hill, when you are moving away from the center of the board you are moving uphill.
- One board is considered uphill and the other is downhill.
- Groups of no fewer than two arrows point the direction of uphill and downhill. Arrows may be positioned to point diagonally (in such a case, diagonal to a diagonal arrow will appear as being horizontal or vertical to the player).

Assassin Rules

The Assassin piece is a dangerous piece for all players involved. When using the option Assassin Rules, both players are expected to understand more than just the rudimentary aspects of the game, as not only do they need to play the piece without the aid of a physical representation of an assassin on the board, but the players must also understand the Assassin's movement, how to read the vertical/horizontal notations, and have a bit of luck on their side.

When playing with Assassin rules, a player may choose to forego the use of an Assassin. There is no benefit to this, except: they will not be spending actions on the movement of an Assassin and they will not have an Assassin piece which can give the opponent points should it be taken.

Both players must agree on using this optional rule in order for any player to use an Assassin (this includes tournaments. Tournaments cannot force players to play a game using Assassin rules). If a player is using an Assassin, they must keep a piece of opaque paper and pen, or other writing surface to the side.

The player must always mark the passage of each turn.

Each time the player moves or uses the Assassin, the player must record this movement in the proper turn the Assassin piece was moved/used.

This record keeping must be done in plain sight, HOWEVER, the player need not show the opponent the records being kept until the end of the game or at any point when the assassin is exposed.

The Assassin must begin in the starting row at the beginning of the game, but cannot begin in any space used by any of the player's starting pieces.

For an Opposing Player, the assassin must begin in Horizontal Row 1. For a Challenging Player, the assassin must begin in Horizontal Row 17. Obviously, an assassin may never begin in Vertical Row 9 (since a King/Queen always occupy that starting position), nor may the Assassin begin in any Vertical Row occupied by a Cavalry piece if the player is playing an Aggressive game (v.6, v.7, v.11, v.12).

An assassin may move up to 3 spaces in any direction.

- An assassin may attack up to 1 space in any direction. When doing so, the attack must be clearly declared that it is coming from the Assassin, and it must be written down with the Assassin's movement record.
- As with all pieces, when the Assassin piece is used (moved and/or attacked), the player must expend 1 action.
- The Assassin need not be revealed unless it takes a command piece, then the player must reveal the position of the Assassin.
- When an Assassin takes an enemy piece, the assassin cannot be moved or take any actions for a full round.
- Any enemy piece may search for an assassin piece by using 1 action. This action reveals the assassin if it is within 1 square (in any direction) of the searching piece. The player searching for the Assassin should mark down the turn they searched and the locations revealed for the end of game. A piece that is searching for an Assassin may not perform any other actions that round unless it revealed the Assassin's location. If the piece is within striking range, the piece may immediately take the Assassin.
- If the Assassin is revealed and it is occupying a location that is also occupied by the enemy, it is immediately taken. If it is occupying a location occupied by a friendly piece, the friendly piece is removed from the board and neither player receives points for the removed piece (however, the Assassin provides points as normal if it is taken after it is revealed).
- If at any time it is discovered that a player cheated when using the Assassin, then not only does the cheater automatically lose the game, but the player receives negative points equal to the maximum point value possible (−60). The player who wins, automatically wins by the maximum number of points possible (60). Likewise, if a player is cheating to make it look like the Assassin player had cheated, that player is penalized with the same loss as the Assassin player would have experienced. In tournament play, if it is discovered that a player has cheated more than once, it results in immediate expulsion from the tournament and possible expulsion from all future tournament play (this counts double for tournament judges).

Because of this, Judges are allowed to keep records of the Assassin Pieces for themselves during the game to insure that the Assassin pieces are being used properly.

When the Assassin Piece is Exposed, Taken or when the game ends, the player using the Assassin must immediately provide their full notes on the Assassin during that game.

The Short Board

Those are the major Long Board designs. As described above, the Long Board is the primary method of play (as the number of pieces is dramatically larger). The secondary method of play uses the Short Board.

It is called a Short Board because the games are dramatically shorter, as each player is gifted with only 3 Archers and 2 Soldiers (or 3 Soldiers and 2 Archers, depending on player preference), 1 Cannon and 1 General.

Like the Long Board, the Short Board can either be played in Checker style (i.e. pieces are placed on the checkers of a 9.times.9 checkered board), or in Graph style (i.e. pieces are placed on the intersecting lines of an 8.times.8 checkered board, and not the checkers).

Again, this is a purely aesthetic choice on behalf of the players, and has no affect on gameplay.

Figure 9:
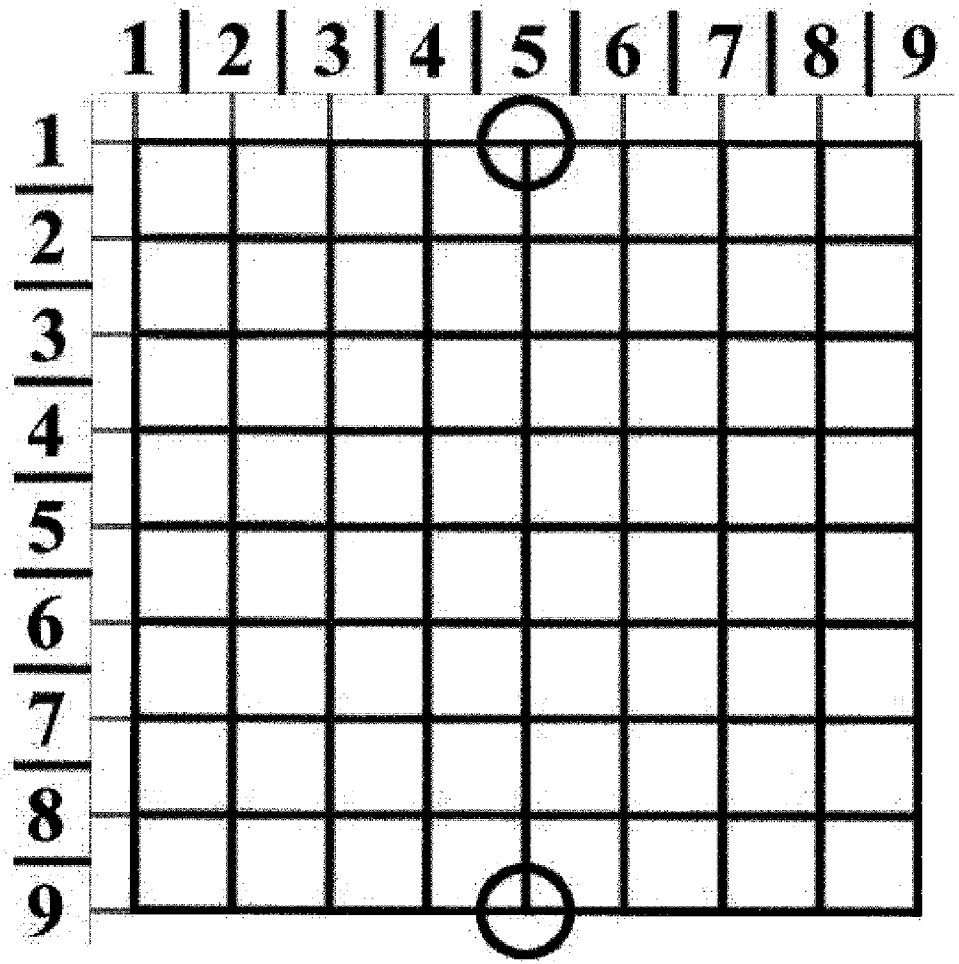

FIG. 8 and FIG. 9 demonstrate the numbering system for both short boards, and relative piece positions (FIG. 9 marks where each General begins play according to the piece placement list given). FIG. 8 also demonstrates the possible relative Defensive and Aggressive positions, using the Opposing and Challenging sides of the board for perspective according to the piece placement list given. FIG. 8 is drawn according to the Checkered Rows being numbered, while FIG. 9 is draw to show the Grid Lines being numbered.

There are some more minor rule exceptions for the Short Board:

Assassin Rules may not be used with the Short Board.

Each player has 2 actions per turn. When a General is eliminated the game is over.

Otherwise the rules for the Short Board are the same for the Long Board (i.e.: The Challenger always begins the game, physical numbers need not be on the boards, etc.).

Piece Placement

Generals are always placed on Vertical Row 5.

For the Opposition: v.5, h.1

For the Challenger: v.5, h.9

Like Generals, Cannons/Catapults are also always placed on Vertical Row 5.

For the Opposition: v.5, h.2

For the Challenger: v.5, h.8

3*Archers—Defensive Opposition:
(v.4, h.3), (v.5, h.3), (v.6, h.3)

3*Archers—Defensive Challenger:
(v.4, h.7), (v.5, h.7), (v.6, h.7)

3*Archers—Aggressive Opposition:
(v.3, h.1), (v.5, h.3), (v.7, h.1)

3*Archers—Aggressive Challenger:
(v.3, h.9), (v.5, h.7), (v.7, h.9)

2*Soldiers—Opposition:
(v.4, h.2), (v.6, h.2)

2*Soldiers—Challenger:
(v.4, h.8), (v.6, h.8)

Archers and Soldiers may be exchanged with each other, as long as both Soldier positions are replaced with 2 Archers each, and all three Archer positions are replaced with three Soldiers respectively.

Short Board Creation/Design

The Short Board has two designs Basic (FIGS. 8&9) and Forest (FIGS. 10&11), though High Terrain may be added, and any present terrain may be ignored (barring player Approval).

Figure 10:
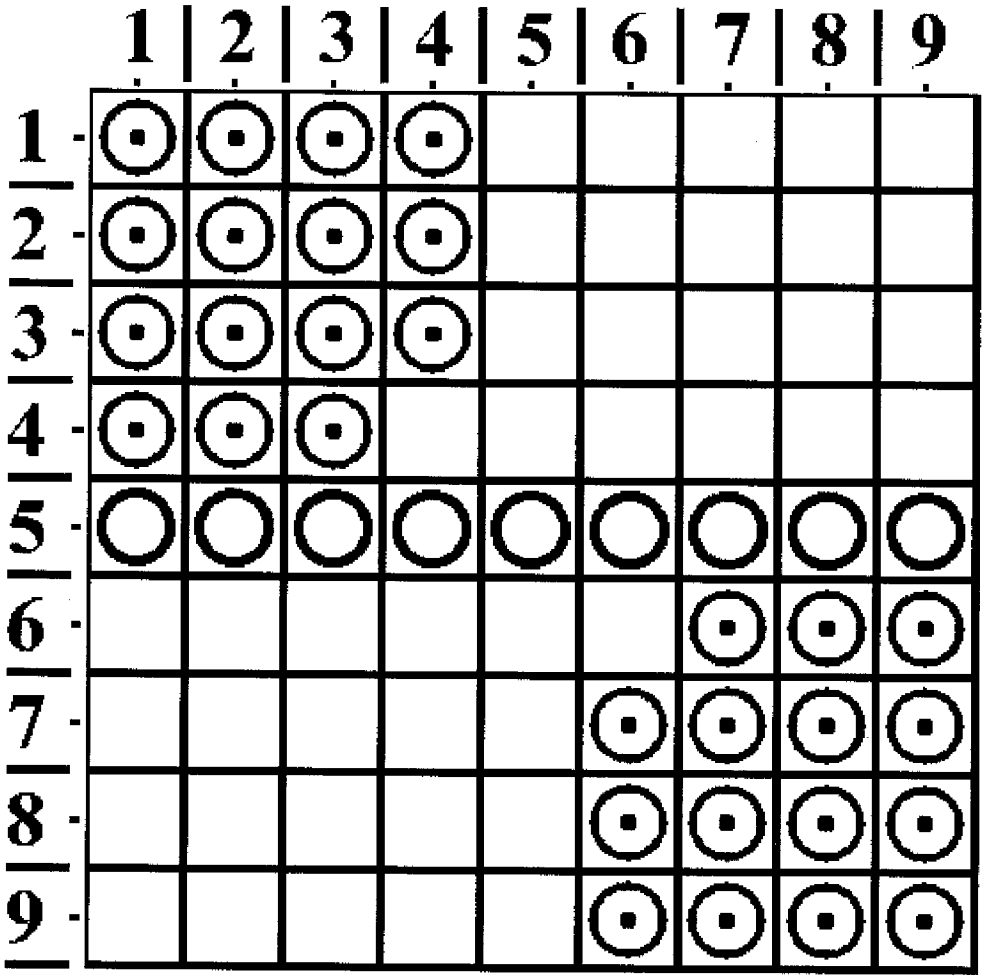
Figure 11:
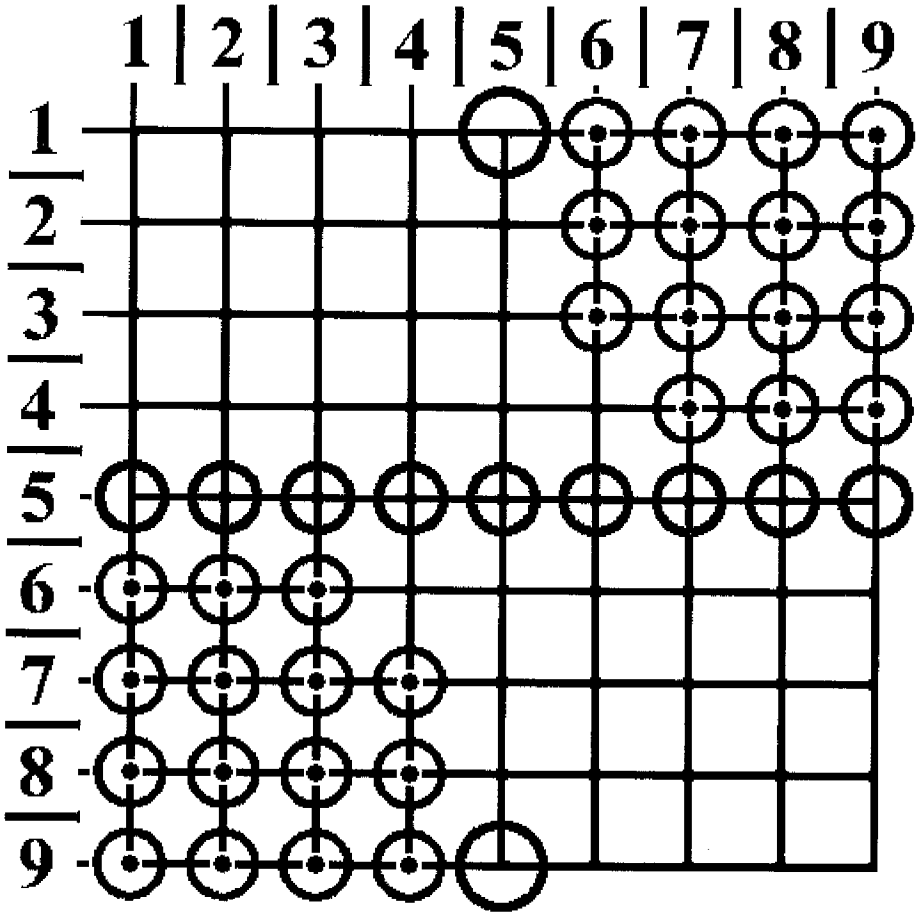

FIG. 10 depicts the Forest Board on a Checkered Format (i.e. Forest and Water markers are placed on the checkers). While FIG. 11 depicts Forest and Water markers on a Grid Format (i.e. they are on the grid lines themselves). For Both Figures: Forest Markers are circles with a dot in the center. They appear green when in color, but dark grey/black when in Black and White. Water Markers are hollow circles which appear blue when in color, but dark grey/black when in Black and White. The marks are on the appropriate intersecting locations according to the prescribed location.

As you can see, spaces marked as "water" divide the board down the central Horizontal Row: (h.5) is entirely "water"

Spaces marked as "trees/forest" are in each respective player's right hand corner: (v.14.times.h.1-3), (v1-3.times.h.4), (v.7-9.times.h.6-9), (v.6.times.h.7-9)

The resulting gameplay from the Short Board is short, but far from simple. The tactics you use for the Short Board may not be the same tactics you use for the Long Board. Likewise, just because there are a fewer less pieces on the board, it does not make the game any more simple.

Score Keeping

Figure 12:
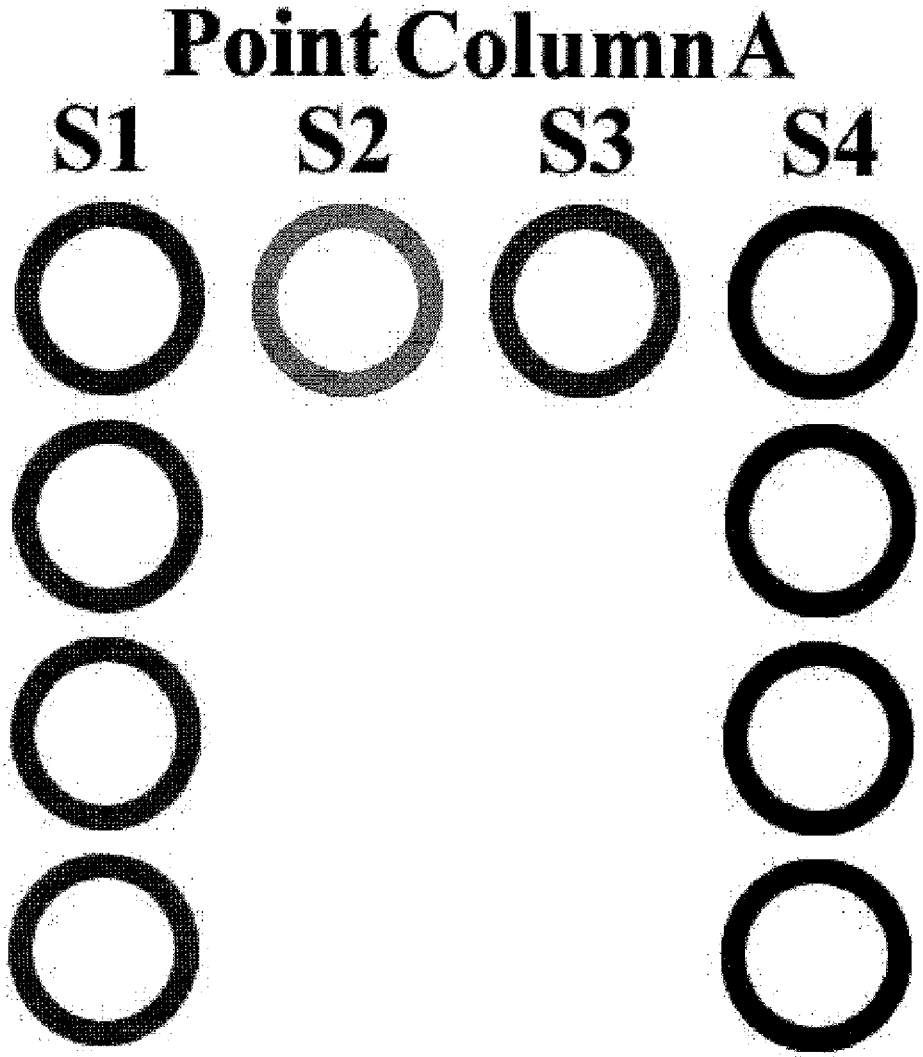
FIGS. 12 & 13 representing Point Column A and Point Column B respectively depict the two different score keeping sheets.
Figure 13:
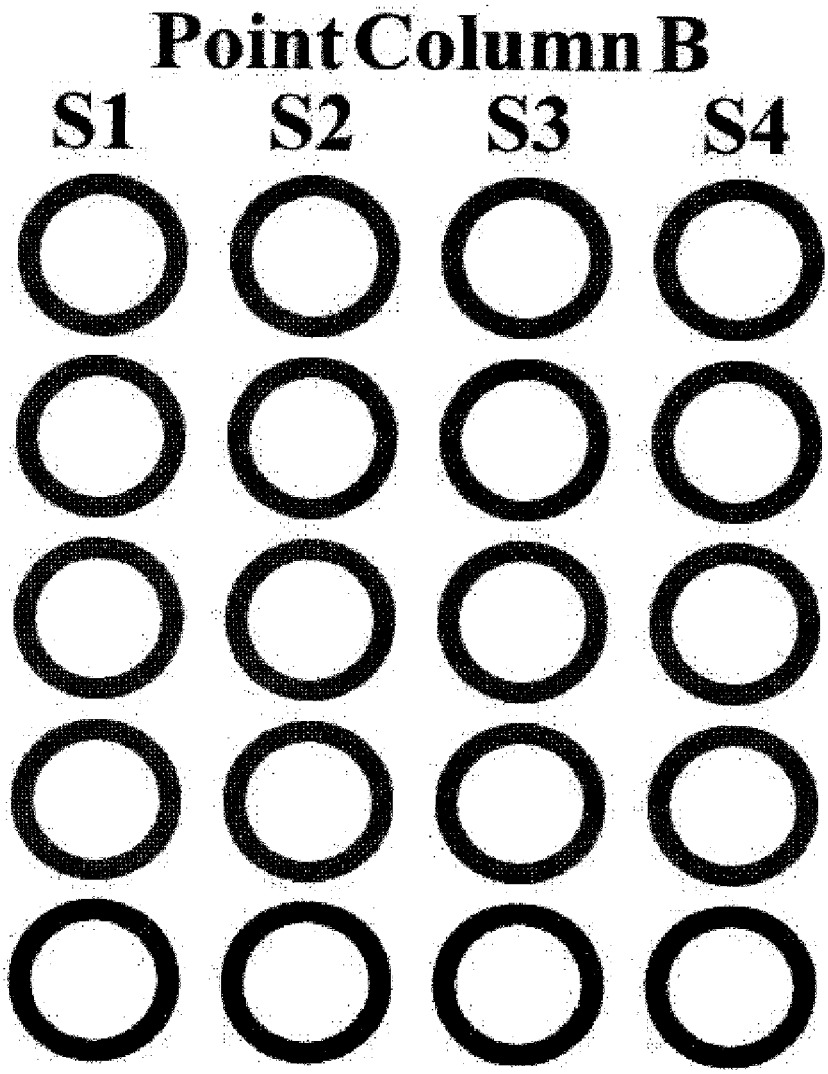
Figure 14:
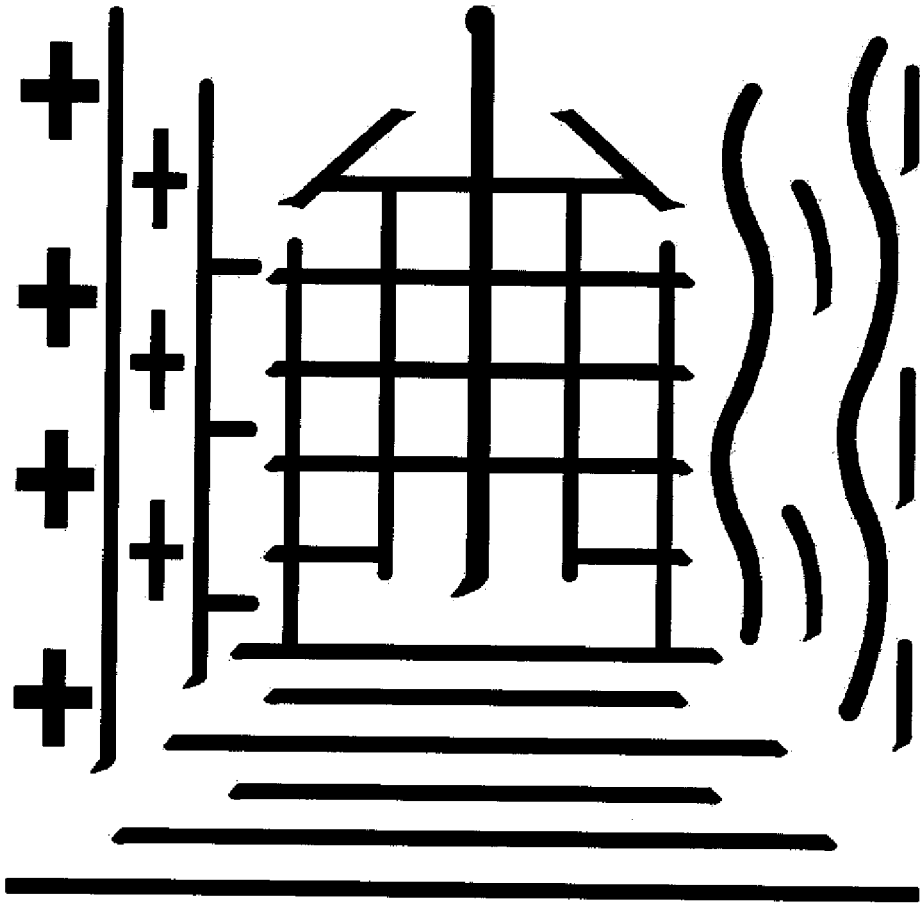
FIGS. 14, 15, 16, 17, 18, 19, 20, 21 & 22 are graphical symbolic representations of what King, Queen, General, Cavalry (Horseman), Cannon/Catapult, Archer, Soldier-Attack, Soldier-Defense & Assassin characters respectively probably should look like but do not need to look like according to embodiments of the present invention.
Figure 15:
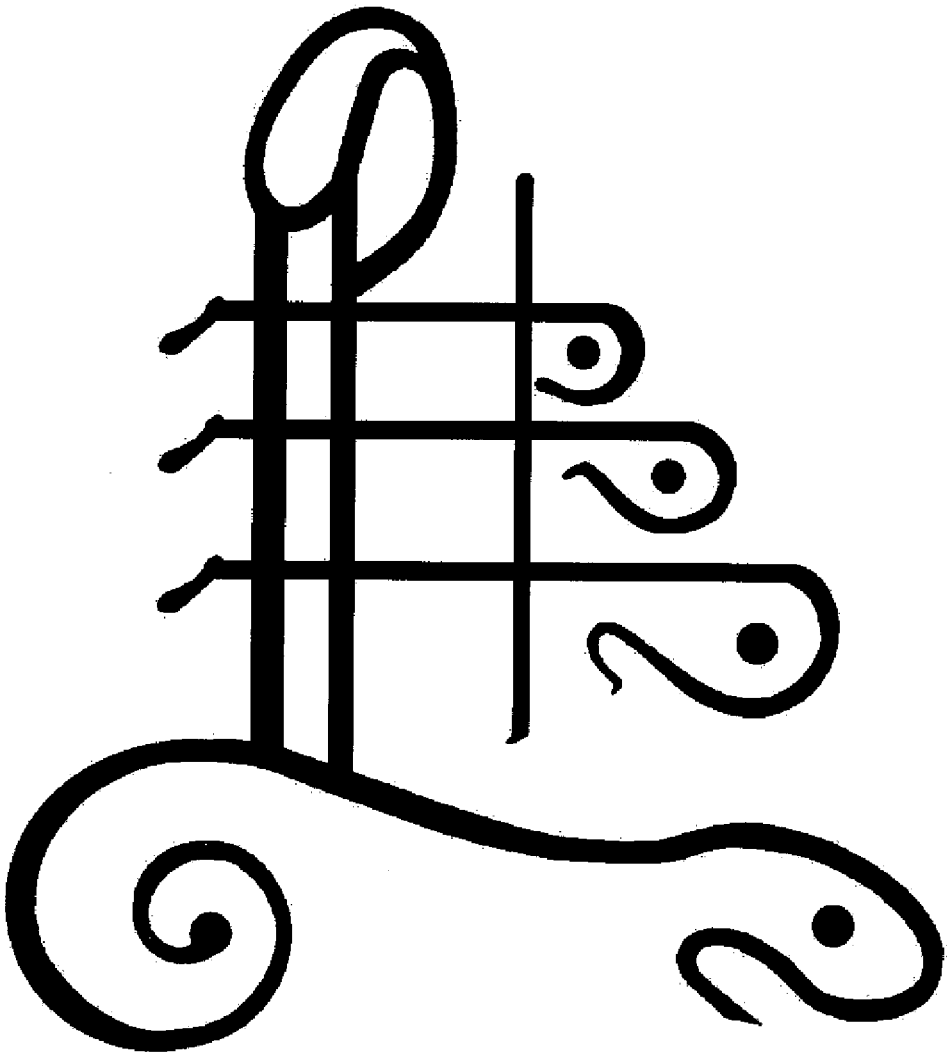
Figure 16:
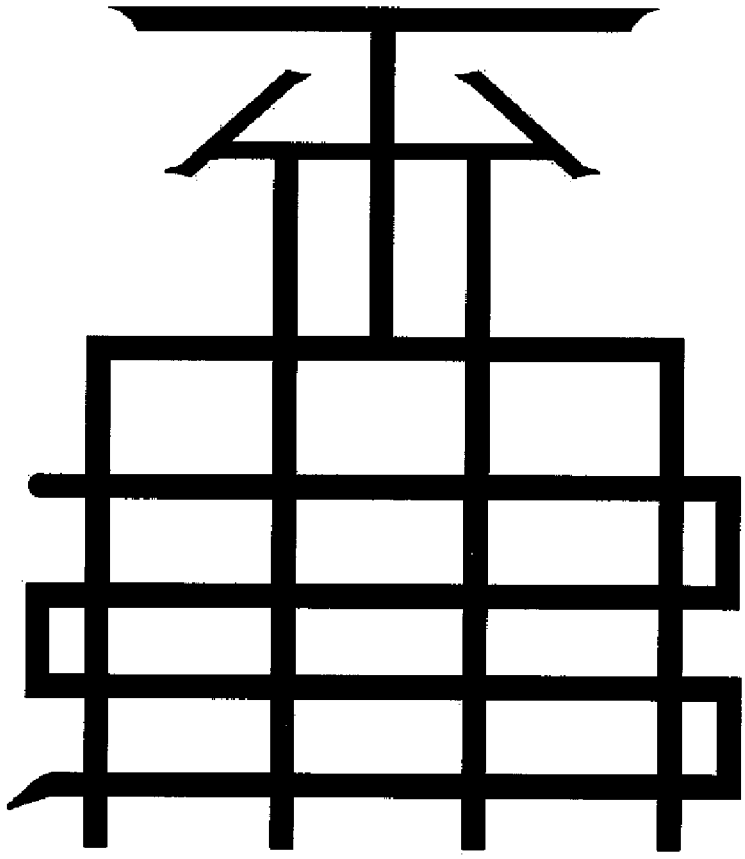
Figure 17:
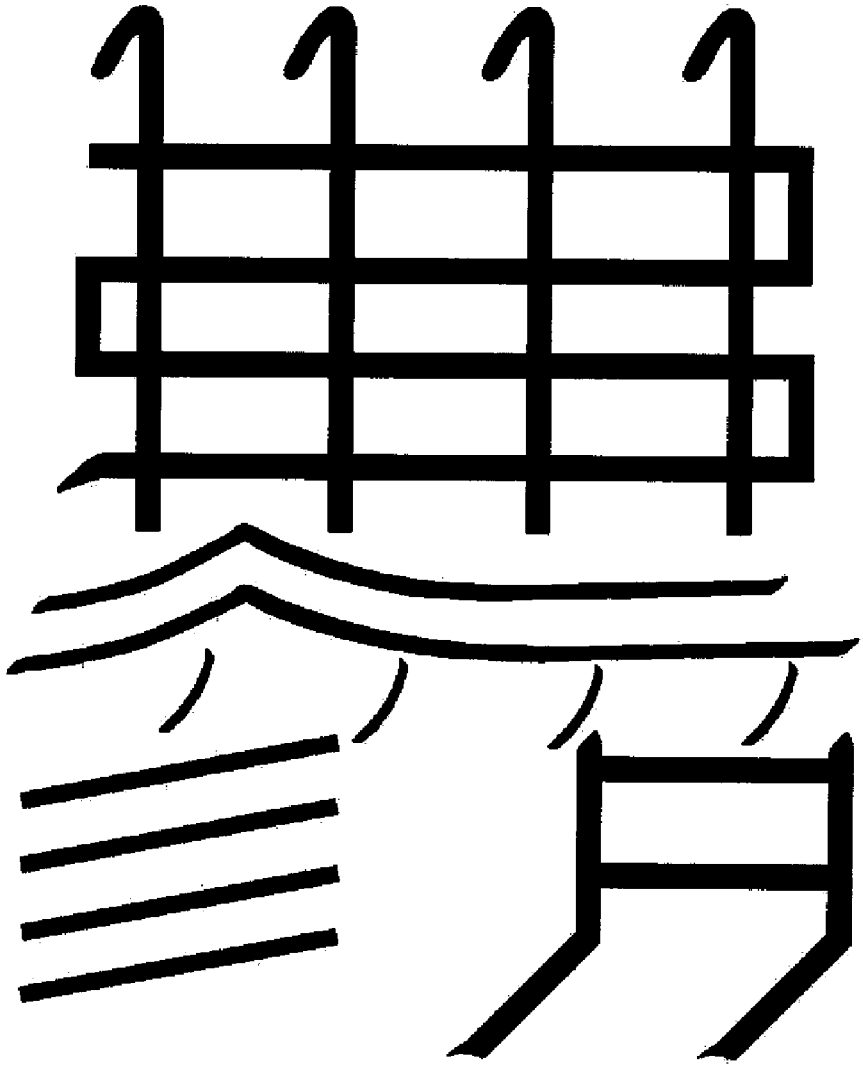
Figure 18:
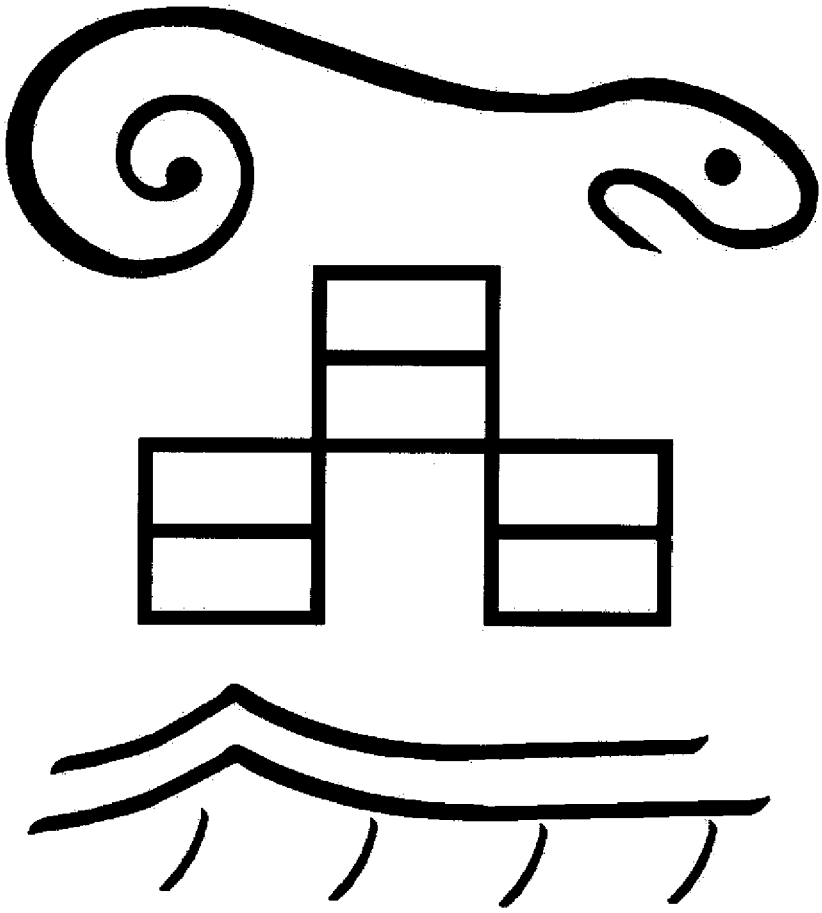
Figure 19:
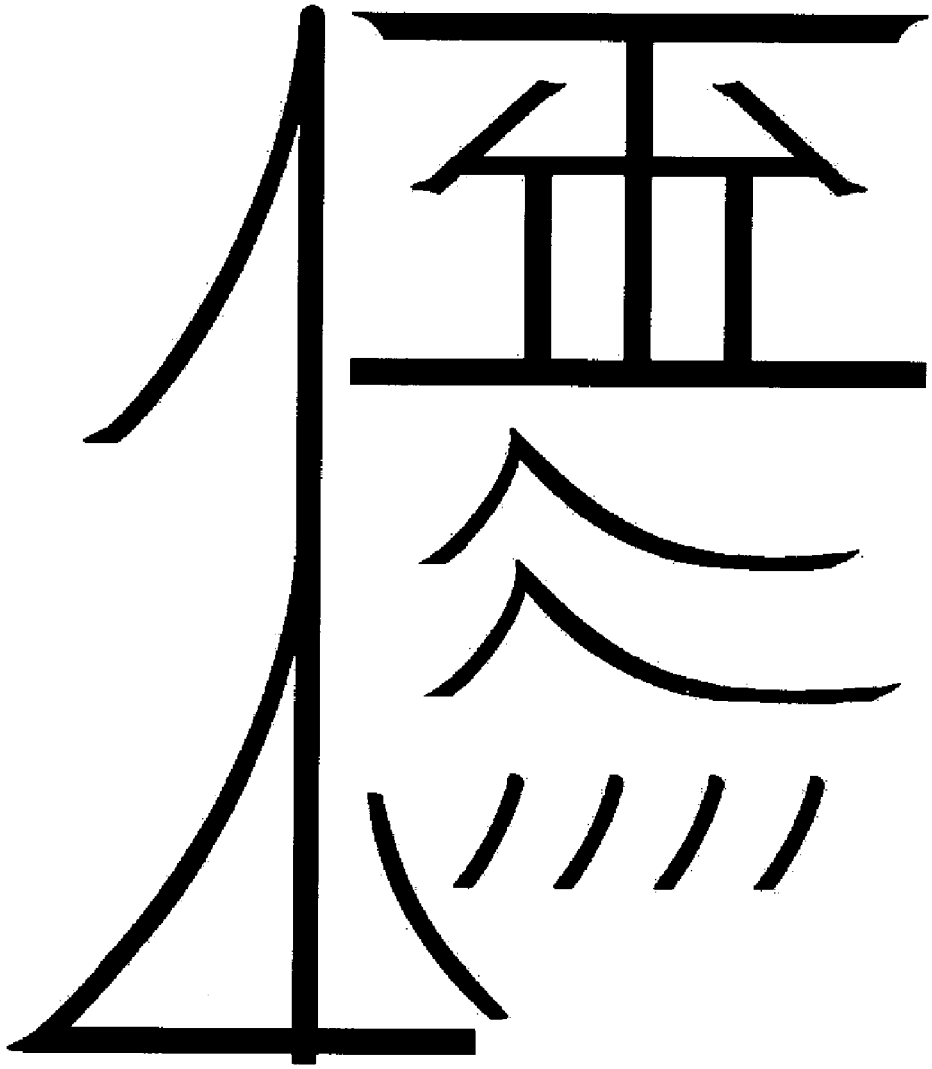
Figure 20:
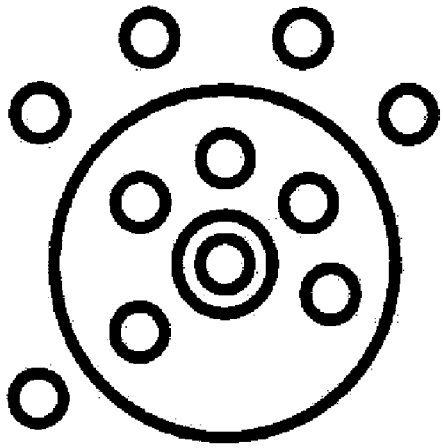
Figure 21:
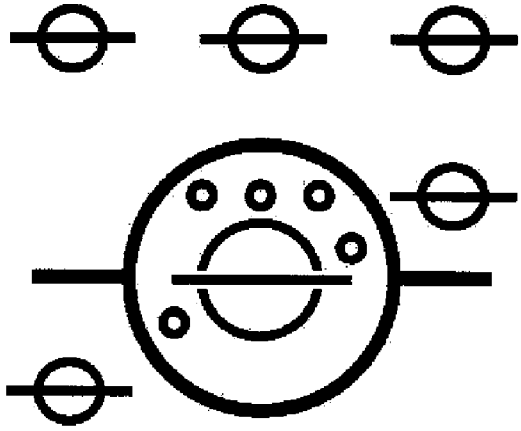
Figure 22:
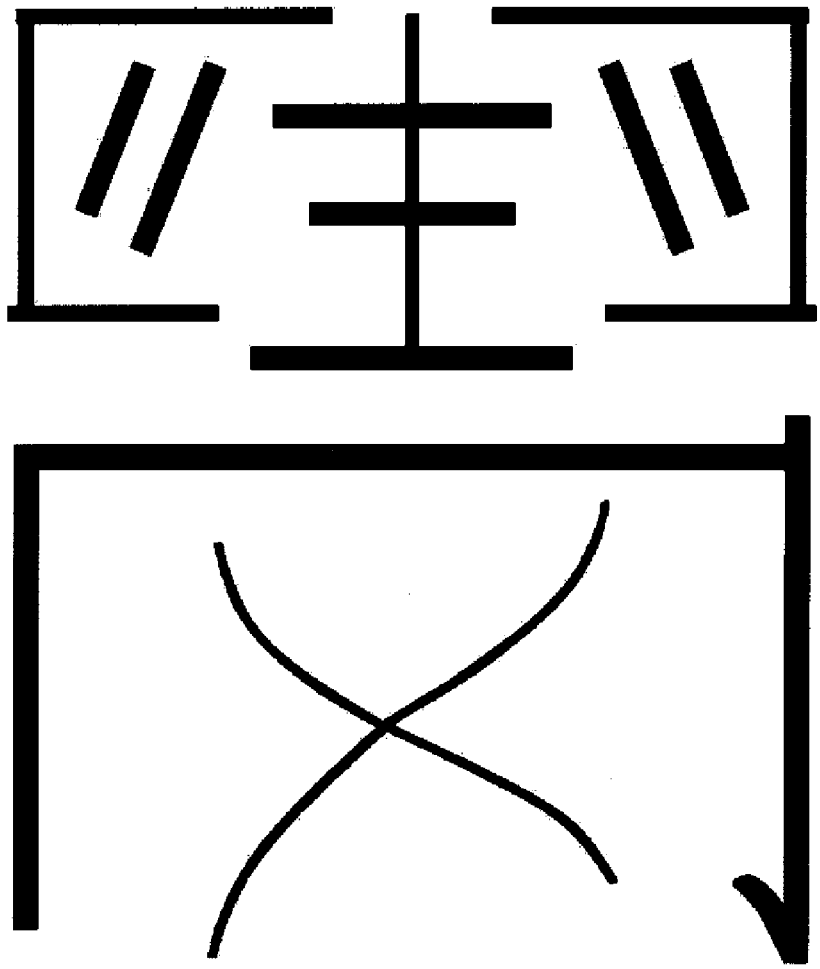

The method of score keeping uses either a Point Column A or Point Column B as illustrated in FIGS. 12 & 13 respectively.

Both score sheets contain four columns, but Point Column B can record up to: 1,295 points (874 if you don't use the bottom row) while Point Column A can only record up to 79 points. These two point Columns can be stretched even further by recording compound values within each columns stretching Point Column B up to a maximum value of 65,535 (but if you manage to get that many points you might as well just write them on a piece of paper).

Compound values for Point Column A are much more manageable, as they reach to a mere 483 maximum.

Standard score keeping will be presented first since it's simpler, easier and only enough score markers have been provided for this method. If you wish to use Compound Score Keeping, that will be described after (as it also assumes you've provided yourself with extra score markers).

Point Column A will be discussed first, as not only is it the smaller of the two boards, but you can also use string or different colored rings on your fingers to keep score if you do not have a score pad present.

Each column in Point Column A has been marked for your convenience. Each column has also been colored differently, as you should use different colored rings or string if you keep score on your fingers (to insure there is no accidental miscounting). On a color printout, S1 is blue, S2 is orange/red, S3 is dark green, and S4 is black. On black and white printouts, the color information appears as either dark grey or black. Each point spot in each column appears as a circle with a hole in it.

Column S1 represents point values 1 through 4, counting down from top to bottom. When you receive your first point you place a marker in the top point slot of Column S1, further points are counted as you move your marker down the column (S2, S3, S4). On the fifth point, you remove the marker from S1 and place a new marker in the single point slot of S2. When you receive your 5.sup.th point, leave the marker in S2, and place a marker in the top row of column S1.

When you have a marker in the bottom of column S1 and a marker in the top of S2 (thus giving you a total of 9 points), and you receive 1 more point (making it 10 points), you place a new marker in column S3, removing all markers from columns S1 and S2.

When you have 19 points (bottom slot of S1 is occupied, as well as the slot in S2 and S3), and you receive your 20.sup.th point, remove all markers from S1, S2 and S3 and place one marker at the top point slot of S4.

You can continue this until there is 1 marker in the highest value point slot of each column equaling a total of 79 points.

The Highest Value for each column is:

S1–4, S2–5, S3–10, S4–60, for a possible total point value of: 79

If you are using string or rings on your fingers to keep score, then column S1 would be the four fingers on your left hand (from pinky to index), S2 is your left thumb, S3 your right thumb and S4 your four right fingers (from index to pinky). As you can see, you are counting from left to right with your hands.

It should be noted that all tournament play is calculated with pencil and paper, not on the fingers. But, if you happen to be in a bind, and don't have a spare sheet or your game markers with you, feel free to use your hands.

If you notice, Point Column B has a lot more finger holes than you have fingers! So keeping score on ones fingers using Point Column B would be nearly impossible (unless you used fingers and toes, but that's getting messy).

Also, if you notice, the bottom row of Point Column B is colored Black, as this row is an optional row. You do not need to use the bottom row, and probably will not need to, unless it is a major tournament, or you and your opponent are playing continuous games over a long period of time. The top four circles of each column in Point Column B appear as BLUE on a color copy. On a black and white copy they appear as either dark grey or black.

There are five open circles in each column in Point Column B. While in Point Column there are Four Open Circles in Columns S1 and S4, and just 1 open circle in Columns S2 and S3.

The method for using Point Column B is the same as using Point Column A, though the point spread is slightly different.

When using Point Column B+its optional row, each row's maximum point spread are as follows:

S1–5, S2–30, S3–180, S4–1080 for a possible total point value of; 1,295

If you choose not to use the bottom row, the maximum point values are as follows:

S1–4, S2–20, S3–100, S4–750 for a possible total point value of: 874

Compound Point Rules

If you absolutely have to have that 65,535 points on Point Column B, or want to know how to record that 483 points on Point Column A, what you do is simple.

First, you need a marker for every Point Slot on the Point Column you've chosen to use. Secondly, when you've reached the highest value point slot of a specific Column (such as the bottom slot of Column S1), you leave the counter there and start counting from the beginning of score pad until you reach the second highest value point slot of that Column.

You keep doing this until every point slot of that Column has a marker on it, before advancing to the next Column. On then, when you advance to the next Column do you remove the markers from the previous Column's slots. From there, you begin all over.

This dramatically increases the possible point values you can record.

Point Column A Maximum Point Values:

S1–10, S2–11, S3–22, S4–440 for a possible total point value of:

483

Point Column B Maximum Point Values:

S8–15, S2–240, S3–3840, S4–61440 for a possible total point value of:

65,535 since you're using Compound Point Rules, it is assumed you are using the optional bottom row.

It is highly suggested that you do not use this method of score keeping, unless you really do have a lot of time on your hands (though, Point Column A does remain manageable with this method, Point Column B certainly does not).

Point Values For Game Pieces

Now that you've learned how to keep score, the following is a list of the point values each piece gives a player when that player takes the piece (removes it from the board through combat).

The first list of values given are for games without using the optional Assassin Rules. The second list of values given are for games which are using the optional Assassin Rules.

Each point value given is for a single piece.

Piece Values without the Assassin

| | |
|---|---|
| Soldiers and Archers | 1 pt |
| Cannons/Catapults | 3 pt |
| Calvary | 3 pt |
| Command Pieces (Generals/King/Queen) | 8 pt |

Piece Values with the Assassin

| | |
|---|---|
| Soldiers and Archers | 1 pt |
| Cannons/Catapults | 2 pt |
| Calvary | 3 pt |
| Assassin | 5 pt |
| Command Pieces (Generals/King/Queen) | 7 pt |

In either case, this gives a possible total point value of 60 for each game (16 for a Short Game).

Players may decide to determine who wins by setting a point value. This can result in multiple games, or even portions of games. i.e.: the winner is chosen by the first person who reaches 79 points in Point Column A. Even if a player takes all of his/her opponent's pieces in the first game, the player would still need to take 19 more points before he/she is declared the winner.

In this case, taking your opponent's King/Queen and all their Generals results in resetting the board, rather than declaring a winner. Also, if the players so choose, if one player is down to 1 action per turn, and you are playing by point value, the player who is down to 1 action may choose to reset the board—thus continuing the game until one person reaches the stated winning point value (your score cards remain the same until the winner has been declared).

In tournament play, however, play must proceed until one player has forfeited that match or lost all his/her command pieces. This is a highly competitive and confrontational rule and should be restricted to tournament games. This is described further under Tournament Ranking.

Tournament Ranking

Tournament Ranking and rules are complex in their simplicity.

First, there are two point values always being scored in a tournament game:

- The Ranking Points (points which determine a player rank).
- The Game Points (points which determine who wins the game).

Handicaps are always applied to Game Point Value and NEVER to the Ranking Point Value.

Second, there are four games to each match. This insures two things:

- Winner is determined by player skill, rather than simple luck (i.e.: a player stumbled onto a winning move in the third match, giving him/her a 2/1 victory).
- By giving a balanced game quotient, it allows the player's ranking to be adjusted more accurately: both players start 2 games as challengers and point spread for an even game set (4 games) can help determine equivocal rank for future plays.

Because handicaps are adjusted for the Game Point Value and not to the Ranking Point Value, a player can conceivably advance in Rank, even tough he/she technically lost the match (due to the opponent's ranking).

This is to insure that Tournament Judges do their best to pit equal ranked players against each other, as pitting a much higher ranked player against a much lower ranked player could cause the higher ranked player an embarrassing loss.

Calculating Ranking Point Value

When calculating the Ranking Point Value of the game, the judges take the total points scored in that game by both players and adds them together to produce a Total Points Scored score for that game.

The judge then determines what percentage of the points were scored by which player, by taking that player's Personal Score and dividing it by the value of Total Points Scored.

This is now known as the Percentage Score.

The judge records the player's Percentage Score for each of the 4 games in the match. These percentage values are compared against each other, only if one of the players won 3 out of the 4 games in the match, The judge then adds the Percentage Score of these 3 games for each player (separately), and divides by 3 to obtain the Average Percentage Score each player scored for these 3 games. If the winning player won all 4 games, then the Percentage Score for all 4 games is added together and divided by 4 to obtain the Average Percentage Score for each player during all 4 games. Remember, you only add the Player's Percentage Scores together with his/her own average Percentage Score throughout the 3 or 4 games, you don't add both player's Percentage Scores together, that'd defeat the purpose.

The judge then compares each player's Average Percentage Score to the following chart:

- If both players personal Average Percentage Score was From 40–59% of the points scored, then they were evenly Ranked players.
- If the losing player's personal Average Percentage Score was from 20–39% of the points scored then that player is in transition for one lower rank, while if the winning players personal Average Percentage Score was from 60–79% of the points scored, then that player is in transition for one higher rank and Cannons/Catapults only provide 1 point for the winner's Game Point Value (only Cannon/Catapult pieces taken by the winner are affected in this way, and they only affect the GPV).
- If the losing player's personal Average Percentage Score was from 0–19% of the points scored then that player is in transition for two lower ranks, and the losing player receives a+1 Handicap point adjustment on all pieces captured. If the winning player's personal Average Percentage Score was from 80–95% of the points scored, then that player is in transition for two higher ranks and Cavalry only provides 1 point for the winner's Game Point Value (only Cavalry pieces taken by the winner are affected in this way, and they only affect the GPV).
- If the winning player's personal Average Percentage Score was from 96–100% of the points scored, then that player is in transition for three higher ranks, and the match is considered a mis-match for handicapped purposes and Command Pieces only provide 5 points for the winner's Game Point Value (only Command Pieces taken by the winner are affected in this way, and they only affect the GPV).

Resolving Transition

Transition is resolved for each player by comparing that player's matches with 3 out of the player's next four opponents. Transitional Rank gains are compared against the players Current Rank. If the player is playing at the same pace against the same relative rank, then the player's Transitional Rank now becomes his/her new Current Rank.

If the player plays at his/her Current Rank, then his/her rank remains unchanged, and the Transitional Rank is discarded.

i.e.:

Player A beat Player B, and ended up with a Transitional Rank of 3, while Player B ended up with a Transitional Rank of 1. Both player's Current Rank was 2 before they played their match. Player A goes on to play 4 more matches with the following results:

Match 1: Lost 1 match against a Rank 3 player with a Transitional Rank Loss of 1.

Match 2: Won 1 match against a Rank 3 player with a Transitional Rank Gain of 3.

Match 3; Lost 1 match against a Rank 5 player without a Transitional Rank Loss of 2.

Match 4: Won 1 match against a Rank 4 player, but had a Transitional Loss of 1.

Match 1's results and the results from the original game between Player A and Player B, cancel each other out.

Match 2 gives Player A a Transitional Rank of +2 against another Rank 3 (which means Player A played as if he/she was 2 ranks higher than that Rank 3).

When playing against a Rank 5 in Match 3, Player A received a Transitional Rank of −2, which means Player A played as if he/she was 2 Ranks or lower than a Rank 5.

When playing against a Rank 4 in Match 4, Player A won in the Game Points scored, but lost in the Percentage Score, giving Player A a Transitional Rank of −1 against a Rank 4.

Since Match 4 said Player A played like a Rank 3, Match 5 said that Player A played like a Rank 3 or Less, and Match 2 was a complete mis-match in Player A's favor (giving Player A a rank gain of +3).

Then Player A's rank is increased by 1 from Rank 2 to Rank 3.

Although Player A lost Match 1 against a Rank 3 of the next four matches he/she played, the following 3 matches were victories, all of them telling Player A that he/she was better than a Rank 2 but not as good as a Rank 4.

Because of these games, Player A's new rank is immediately adjusted to a Rank 3.

Player B, however, played less exciting games, each one stating that he/she was a Rank 2, no more, no less.

(Tournament Champions who tie in Game Point Values have their win/loss record for that tournament compared. If it remains a tie, they play tie breaker game(s), until won by point value)

Game Points

As stated earlier, Ranking Points are kept separate from Game Points, as Ranking Points determines Rank, while Game Points determines who wins the match by use of Handicap.

The below handicaps are added or subtracted to the Game Point total, along with any applicable Handicap Point adjustments the player may receive when Calculating the Ranking Point Value at the end of the game (see Calculating Ranking Point Value entry).

The table compares the Player's Ranks against each other, then applies the appropriate Handicap to the Game Point total. Players within 3 ranks of each other do not use this table.

Long Board Tournament Handicap Guide

| Lower Ranked Player | Rank Differential | High Ranked Player |
|---|---|---|
| +0 pts. | 4 | −4 pts. |
| +6 pts. | 5 | −8 pts. |
| +12 pts. | 6 | −12 pts. |
| +18 pts. | 7 | −16 pts. |
| +24 pts. | 8+ | −20 pts. |

Tournaments have a set Game Point Value for determining Match Wins and Tournament Champions (decided upon prior to the Tournament). Ties for Tournament Champions are resolved by point value.

Match wins can never be set below 181 pts or more than 240 pts (although a handicapped player could still conceivably win a Match in the 3.sup.rd game with 181 pts).

Cheating and Substitute Players:

Should a cheater ever be caught, that cheater is expelled from the tournament and automatically loses the game with a negative point value=to the maximum of that game (for long board this is −60 pts per game and −240 per match), is expelled from the tournament and must be recorded for possible expulsion from all future official tournaments (if the cheater is a repeat offender). The opposing player automatically wins that game by the maximum point value available, but does not win the match by maximum value. Instead, the winner must be matched up with a new player of comparable rank with whom to replay the match. This new player is called the Substitute Player. If the Substitute Player has already played and won or played and lost in this tournament, then this game is not calculated against or with his/her tournament score. Instead, the score is applied only to the player who was cheated against.

In such an instance, if a Substitute Player who already qualified for the next tier of play loses to a player who was cheated against, both players would still advance to the next tier (since the game holds no bearing over the Substitute Player's tournament rank).

Likewise, if there is ever an uneven tier (where there is 1 player left without someone to play against), a Substitute Player of comparable rank should be picked to play against such a player.

Short Board Tournament Rules:

The rules for the short board tournament are the same EXCEPT the maximum point value of a Short Board game is 16 points (1 General—8 points, 1 Cannon/Catapult—3 points, Combination of any two and three Archers and Soldiers equaling 5 pieces−5 points=16 points).

As such, any maximum game awards should be adjusted for this 16 points from the Long Board's 60 point value. A minimal point value of a technical win for a Short Board match could never be set below 49 or above 64 points (instead of the Long Board's 181 and 240 pts).

Because of these point adjustments, the Handicap Guide must be adjusted as well:

Short Board Tournament Handicap Guide

| Lower Ranked Player | Rank Differential | High Ranked Player |
|---|---|---|
| +0 pts. | 4 | −1 pts. |
| +1 pts. | 5 | −2 pts. |
| +2 pts. | 6 | −3 pts. |
| +4 pts. | 7 | −4 pts. |
| +6 pts. | 8+ | −5 pts. |

If you notice, the point adjustments for the Handicap value retain the same aspect ratio as with the Long Board. All other references to point values should be adjusted as demonstrated above to fit the proper game (whether it is Long Board or Short Board), otherwise, the tournament rules themselves remain the same.

There is one final note: Tournament ranking for Long Board and Short Board tournaments must remain separate for a number of reasons. Several of those reasons include the facts that a player may be excellent at one form of the game, but poor the next, the point values are different, and not all players will play both sets of tournaments.

Game System, Graphics, Rules and Tournament Ranking designed and created by Kevin Joel Conner.

What I claim as my invention is:

1. A method of playing a game, the method comprising:

providing a long board, the long board having a 17 by 17 orthogonal array of locations upon which playing pieces can be located during play inscribed; the locations definable by both a vertical number and a horizontal number indicating the position of the location from an origin, the origin being a corner of the board;

providing a first set of playing pieces to a challenging player, the first set of placing pieces including the following types: (i) one first piece, (ii) two second pieces, (iii) two third pieces, (iv) four fourth pieces (v) nine fifth pieces, and (vi) nine sixth pieces;

providing a second set of playing pieces to a defending player, the second set of placing pieces including the following types: (a) one seventh piece, (b) two eighth pieces, (c) two ninth pieces, (d) four tenth pieces (e) nine eleventh pieces, and (f) nine twelfth pieces, all of the first through twelfth type pieces being distinguishable from other type pieces;

placing the first piece in a location defined by a horizontal number 17 and a vertical number 9;

placing the seventh piece at a location defined by a horizontal number 1 and a vertical number 9;

placing one second piece at a location defined by a horizontal number 14 and a vertical number 4;

placing the other second piece at a location defined by a horizontal number 13 and a vertical number 14;

placing one eighth piece at a location defined by a horizontal number 5 and a vertical number 4;

placing the other eighth piece at a location defined by a horizontal number 4 and a vertical number 14;

placing one third piece at a location defined by a horizontal number 13 and a vertical number 4;

placing the other third piece at a location defined by a horizontal number 12 and a vertical number 14;

placing one ninth piece at a location defined by a horizontal number 6 and a vertical number 4;

placing the other ninth piece at a location defined by a horizontal number 5 and a vertical number 14;

placing the fourth pieces, the fifth pieces and the sixth pieces at locations wherein each piece of the fourth, fifth and sixth pieces is within three spaces of at least one of the first, second and third as measured vertically, horizontally or diagonally;

placing the tenth pieces, the eleventh pieces and the twelfth pieces at locations wherein each piece of the tenth, eleventh and twelfth pieces is within three spaces of at least one of the seventh, eighth and ninth pieces;

the challenging player declaring one or more actions, wherein the number of actions declared in a round of play is equal to or less than the number of first, second and third pieces the challenger has on the board and wherein an action comprises one or both moving a particular piece of the first set and attacking a particular piece of the second set;

the defending player declaring one or more actions, wherein the number of actions declared in a round is equal to or less than the number of seventh, eighth and ninth pieces the challenger has on the board and wherein an action comprises one or both moving a particular piece of the second set and attacking a particular piece of the first set, wherein an action for: (1) the first and seventh piece comprises moving up to three locations in any direction and attacking up to one location away in any direction; (2) a second and eighth piece comprises moving up to two locations in any direction and attacking up to one location away in any direction; (3) a third and ninth piece comprises moving one location away in any direction and attacking in any direction a distance necessary to attack a piece from the opposing set or until an edge of the board is reached; (4) a fourth and tenth piece comprises moving up to three locations away and attacking any piece of an opposing set in any location into which it moves; (5) a fifth and eleventh piece comprises one of (i) moving two locations away, (ii) moving one location and attacking one location and (iii) attacking two locations away; and (6) a sixth and twelfth piece comprises moving one location away and attacking any piece of an opposing set in any location into which it moves;

removing pieces of one set attacked by pieces of the other set; and repeating (a) said challenging player declaring one or more actions, (b) said defending player declaring one or more actions and (c) said removing pieces.

2. The method of claim 1, wherein (a) the first and seventh pieces are designated as queens or kings, (b) the second and eighth pieces are designated as generals, (c) the third and ninth pieces are designated as cannons or catapults, (d) the fourth and tenth pieces are designated as cavalry, (e) the fifth and eleventh pieces are designated as archers, and (f) the sixth and twelfth pieces are designated as soldiers.

3. The method of claim 1, wherein (a) the first set further comprises a virtual thirteenth piece, (b) the second set comprises a virtual fourteenth piece, (c) the thirteenth and fourteenth pieces are not normally visible and an action for either the thirteenth and fourteenth pieces comprises moving up to three locations away and/or attacking up to one location away; and further comprising (i) placing the thirteenth piece at a location partially defined by horizontal number 17, and (ii) placing the fourteenth piece at a location partially defined by horizontal number 1.

4. The method of claim 3, further comprising a challenging player recording the locations of the thirteenth piece on a writing surface.

5. The method of claim 1, wherein the first, second, seventh and eighth pieces are designated as command pieces and the remaining pieces are designated as standard pieces.

6. The method of claim 4, wherein the location of either the thirteenth or fourteenth piece is revealed to an opposing player when the piece attacks and takes a first, second, seventh and eighth pieces of the opposing player.

7. The method of claim 1, wherein said repeating continues until only one of the first and second sets of pieces remaining on the board comprises at least one of the first, second and third pieces or one of the seventh, eighth and ninth pieces respectively.

8. The method of claim 1, further comprising awarding points to a player for pieces of the opposing player taken from the game.

9. The method of claim 8, wherein (a) one point is awarded for each fifth, sixth, eleventh or twelfth piece removed from the game, (b) two points are awarded for each third or ninth piece removed from the game, (c) three points are awarded for each fourth or tenth piece removed from the game, (d) seven points are awarded for each first, second, sixth or seventh piece removed from the game.

10. The method of claim 8, wherein said repeating continues until either the challenging or defending player reaches a predetermined point total.

11. The method of claim 1, wherein the board includes locations designated as forest, and wherein the fifth and eleven pieces can only attack a maximum of one location away when attacking into a forest.

12. The method of claim 1, wherein the board includes locations designated as water, and wherein the ability of any piece to move through a water location during an action is reduced by one but no less than a minimum of one.

* * * * *